US006018825A

United States Patent [19]

Enomoto

[11] Patent Number: 6,018,825

[45] Date of Patent: Feb. 1, 2000

[54] TOILET SEAT AND A TOILET STOOL HAVING IT

[75] Inventor: Toshio Enomoto, Yokohama, Japan

[73] Assignee: Koken Engineering Ltd, Kanagawa, Japan

[21] Appl. No.: 09/095,893

[22] Filed: Jun. 11, 1998

[30] Foreign Application Priority Data

Jun. 11, 1997 [JP] Japan ..... 9-154157

[51] Int. Cl.[7] ..... A47K 13/00

[52] U.S. Cl. ..... 4/237

[58] Field of Search ..... 4/237, 238, 240, 4/241, 234, 236

[56] References Cited

U.S. PATENT DOCUMENTS 1,510,493 10/1924 Dillard ..... 4/237

*Primary Examiner*—Henry J. Recia
*Assistant Examiner*—Peter deVore

[57] ABSTRACT

A toilet stool capable of being seated for use in defecation or urination, and a toilet stool for use in defecation or urination which is characterized by mounting a toilet seat whose opening width can be varied. The toilet stool comprises a toilet seat having two foliar plates capable of freely falling onto the upper surface of a peripheral edge portion of the toilet stool as a pedestal and a toilet lid mounted on the toilet seat; wherein the foliar plates of the toilet seat is linked to the driving portion of the rear portion of the toilet seat so that the foliar plates of the toilet seat vary the opening width of the toilet seat.

6 Claims, 7 Drawing Sheets

1.. STOOL

2.. THE UPPER SURFACE OF THE PERIPHERAL PORTION OF THE OPENING

3.. OPENING WIDTH OF THE TOILET SEAT

4.. FOLIAR PLATE OF THE TOILET SEAT

5.. COVER OF THE ORBIT PORTION

7: GEAR MOTOR

8: ARMLIKE ONE SIDE GEAR

9: METAL PLATE

10: TOP

11: ANTI-VIBRATION RUBBER

12: GROOVE

13: ARM JOINT

14: ROTATION SHAFT (FULCRUM)

15: ROTATION JOINT (METAL FITTING)

16: SCREW STOP

17 : GEAR MOTOR

18 : ROTATION GEAR

19 : ROTATION SHAFT (FULCRUM)

20: MESHING GEAR

21: CAP-LIKE SUPPORT

22: SUPPORT AS A FULCRUM

23: PIN INSERTION HOLE

24: PIN

25: METAL FIXED PLATE

26 OPERATION KNOB

4a LEFT FOLIAR PLATE OF THE TOILET SEAT

4b RIGHT FOLIAR PLATE OF THE TOILET SEAT

27: STOOL LID

28: TOILET SEAT FOR ADULTS

29: TOILET SEAT FOR CHILDREN

30: STOOL

31: STOOL

32: CABINET

33: CASE

34: TOILET SEAT FOR CHILDREN

35: TOILET SEAT FOR ADULTS

36: LID OF THE TOILET SEAT

TOILET SEAT AND A TOILET STOOL HAVING IT

BACKGROUND OF THE INVENTION

1. Field of the Invention

The present invention relates to a toilet stool capable of being seated for use in defecation or urination, and to a toilet stool for use in defecation or urination which is characterized by mounting a toilet seat whose opening width can be varied.

More specifically, the present invention relates to a toilet stool in which the opening width of a usual toilet seat for adults can be adjusted to a desired size for children manually or electrically.

The toilet seat for varying the width of an opening is a toilet seat, which is fallable on the upper surface of a peripheral portion of the main body of the toilet stool as a pedestal, characterized in the following structure. Namely, the two toilet seat foliar plates constituting the toilet seat are foliar plates which are bilateral symmetrical and are curved and have a larger width than the width of the upper surface of a peripheral portion of the toilet stool, and the foliar plates of the toilet seat are linked at the portion of driving of the rear portion of the toilet seat so that the width of the opening may be changed. These foliar plates of the toilet seat are driven manually or electrically in the front and rear directions or the left and right directions, simultaneously the left and right foliar plates being moved, using a linking fulcrum there of as an actuation shaft to vary the width of the opening of the toilet seat.

2. Description of the Prior Art

It has been the practice to mount a toilet stool lid capable of falling and a toilet seat capable of falling on a toilet stool capable of being seated for use in both defecation and urination. Generally, when a man urinates, the toilet stool lid is properly pulled upwardly by a manual operation and thereafter as required, the toilet seat is pulled upright by manual operation and he goes to stool. However, the opening width of this seat is usually sufficient for an adult to sit, and is too large for a child and it is inconvenient for a child to sit.

In order to mitigate this inconvenience, a toilet seat for men is provided on the toilet stool shown in FIG. 6, when a child goes to stool, a stool lid is removed from the stool securing portion, and a toilet seat for children is mounted to fall downwardly to give a stool.

Japanese Laid-Open Patent Publication No. 293056/1993 discloses a multi-functional toilet stool comprising a cabinet provided at a rear portion of the toilet stool, a case provided between the cabinet and a toilet seat, a toilet seat for adults provided on the upper surface of an outer portion of the case, a toilet stool lid provided on the toilet seat, and housing at least one of a child toilet seat, a toilet seat for urination of men, a human body washing apparatus and a toilet stool washing apparatus into the cabinet to provide a multi-functional toilet stool apparatus, wherein when a child goes to stool, a child toilet seat is placed electrically in and out of the multi-functional toilet stool apparatus. (See FIG. 7.)

SUMMARY OF THE INVENTION

However, in the above proposal, when a child seat is not used, the seat must be removed and in another place in the toilet, the removed seat as required must be mounted by a person, and it is difficult to find a suitable place for placing the removed seat. When an adult goes to stool, a back portion of a child toilet seat which is pulled up may have an anxiety of being contacted with the back of the adult and a feeling of discomfort or a feeling of dirtiness may be exerted on the adult.

In the proposal of the above-cited Patent Publication, as shown in FIG. 7, for example, when a switch is depressed to use a child toilet seat housed in the cabinet, an electrical driving device acts to move the child toilet seat housed in the cabinet whereby the child toilet seat is pulled up onto the upper surface of the opening peripheral edge portion of the stool main body while the stool lid is pushed upwardly through the opening portion of the rear portion of the case and the opening portion of the front surface.

After the child went to stool and again depressed the switch, the driving device operates reversely to move the child toilet seat into the cabinet and house it. When in this condition the erecting adult toilet seat is brought down, an adult is seated and can go to stool.

The toilet stool proposed in the above Laid-Open Patent Publication will fully dissolve the inconvenience at the time of a child going to stool. However, it is provided with a multi-functional apparatus including a child toilet seat. Namely, the toilet stool contains a case and a cabinet into and out of which many devices are contained and removed. These devices are compactly housed in the cabinet. The size of the child toilet seat is as large as the stool. For this purpose much spaces are required in the toilet, and in addition, as the devices become complex structures, the toilet stool becomes high in cost as a stool.

As a result of assiduous investigations by the present inventors, it has been found that by varying the opening width of one toilet seat for adults without exchanging the toilet seat as conventionally practised, one object of the present invention is accomplished by solving the inconvenience at the time when a child goes to stool.

It is an object of the present invention to provide a toilet seat thereby to solve the above-mentioned problem, and to provide a toilet stool in which a toilet seat itself has a simple structure, the same size as a conventional and ordinary toilet seat and is not particularly high in cost, and to provide a toilet stool provided with a toilet seat whose opening width of an ordinary toilet seat for adults can be changed simply to the width of a child toilet seat, and a toilet seat therefor.

According to the present invention, there is provided a seatable toilet stool concurrently used for defecation and urination, which when, for example, a child seats on a toilet seat, a toilet seat composed of two foliar plates which are freely fallable onto the upper surface of an opening peripheral edge portion of the toilet stool main body and are bilaterally symmetrical is driven using the upper surface of the opening peripheral edge portion as a pedestal in the front and rear directions or in the left and right direction whereby the opening width of the toilet seat for adults is narrowed to the opening width of the toilet seat for children and the toilet seat is used for the narrowed opening width for children.

The toilet seat of the present invention in which the opening width of the toilet seat is variable, and the toilet stool provided with this toilet seat are such that when the opening width of a toilet seat capable of falling for ordinary adults as shown in FIG. 1 is changed to the opening width of a toilet seat for children by driving the toilet seat foliar plates 4 to fall on the upper surface 2 of the peripheral edge portion of the toilet stool as the pedestal, 1. the opening width of the toilet seat can be narrowed by driving the foliar plates 4 of the toilet seat on the pedestal manually or electrically in the front and rear directions;

2. the opening width of the toilet seat can be narrowed by driving the foliar plates 4 of the toilet seat on the pedestal manually or electrically inwardly of the upper surface 2 and driving them symmetrically with respect to the right and left, and mounting a toilet seat used.

Figure 1A:
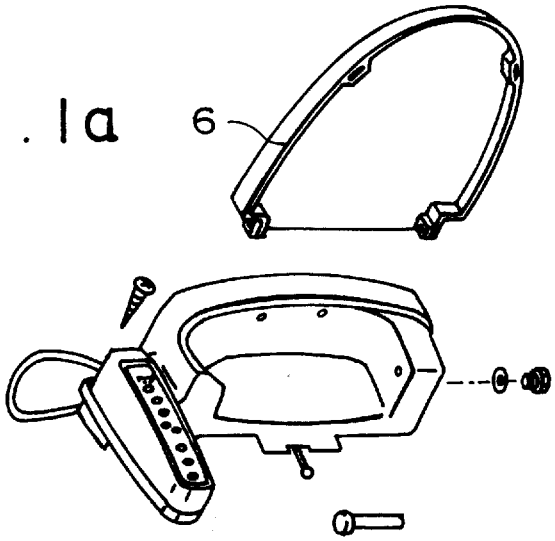
FIGS. 1(*a* to *d*) are a perspective view showing constituted portions of a toilet stool provided with a toilet seat whose opening width of the toilet stool according to the present invention.
Figure 1B:
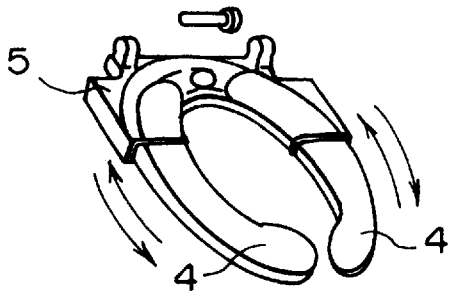
Figure 1C:
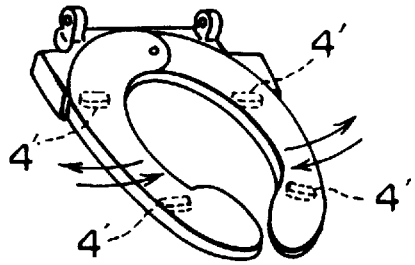
Figure 1D:
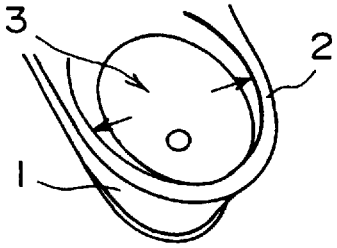
Figure 2A:
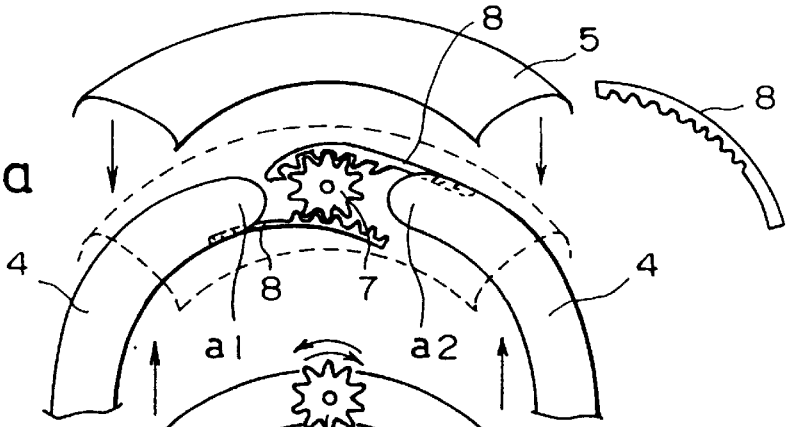
FIGS. 2(*a* to *d*) are a top view and a partially front sectional view of a driving portion and foliar plates of a toilet seat whose opening width can be varied by driving the foliar plates described in Example 1 of the present invention to the front and rear directions.
Figure 2B:
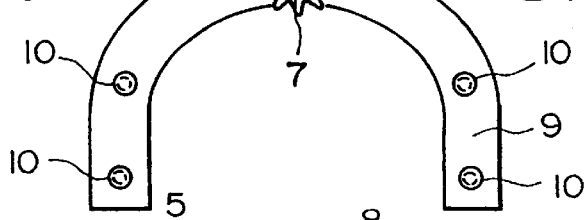
Figure 2C:
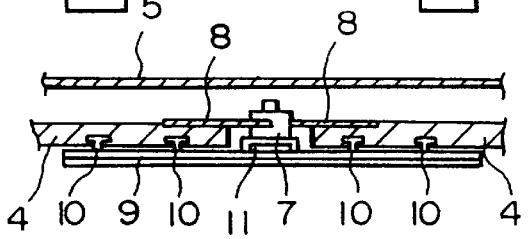
Figure 2D:
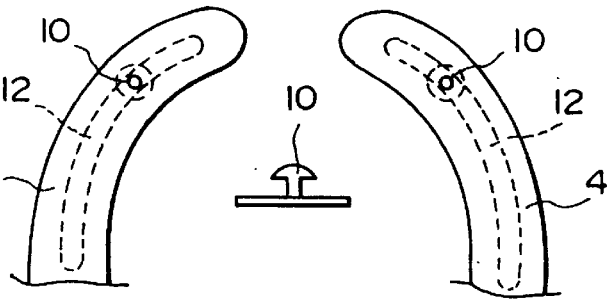

The reference numerals in the drawings show the following devices.

1 Toilet stool
2 Upper surface of the peripheral portion of the stool
3 Opening (or opening width) of the toilet seat
4 Foliar plates of toilet seat
4' Supporting leg of the plates of a toilet seat
5 Cover for a driving portion
6 Stool lid
7 Gear motor
8 Arm-like one-side gear
9 Fixed plate
10 Top
12 Groove on the back surface of a foliar plate of a toilet seat
13 Arm joint
14 Rotating shaft (fulcrum)
15 Rotation joint metal fitting
17 Gear motor
18 Rotation gear
19. Fulcrum
20 Biting gear
21 Cap-type support
22 Receiving support (fulcrum)
23 An elliptical hole for insertion of a pin
24 Pin
25 A fixed plate
27 Stool lid
28 Adult toilet seat
29 Child toilet seat
30 Toilet stool
31 Toilet stool
32 Cabinet
33 Case
34 Child toilet stool
35 Adult toilet stool
36 Stool lid

PREFERRED EMBODIMENT OF THE INVENTION

The stool of the present invention in which the opening width of a toilet seat is variable by driving two foliar plates constituting the toilet seat by one touch manually or electrically, characterized in that the foliar plates constituting the toilet seat are easily driven symmetrically in the front and rear directions or in the left and right directions.

Examples of driving the foliar plates of the toilet seat are preferably as follows.

1. In the driving portion described in FIG. 2, the gear i.e. a driving rotating gear, 7 is a motor-equipped rotating gear, the gear 7 bites with two arm-like one-side gears 8 fixed to one end a1 and a2 of the foliar plates 4 of the toilet seat and rotates the gear 7 whereby the opening width of the toilet seat is varied.

2. In the driving portion described in FIG. 3, both end portions of b1 and b2 of a member metal fitting 15 rotating on a fulcrum 14 are linked rotatably at the other ends b1 and b2 of an arm joint 13 fixed at one ends a1 and a2 of the foliar plates 4 of the toilet seat, and the opening width of the toilet seat is varied by rotating the member fitting 15 on the fulcrum 14.

Examples of driving the foliar plates of the toilet seat to the left and right are preferably used as shown below.

3. In the driving portion described in FIG. 4, gears 17 and 18 which mesh with each other are required, the gear 17 is a rotating gear having a fulcrum 17' as an actuation shaft and the gear 18 has a fulcrum shaft 18', and these gears are operated in union by meshing a gear 20 formed at the end portions of two foliar plates 4 supported in the pedestal at the fulcrums 17' and 18', and by rotating the gear 17, the foliar plates 4 are driven on the fulcrums 17' and 18' symmetrically to the left and right whereby the opening width of the toilet seat is varied.

4. In the driving portion described in FIG. 5(*a*), there is a toilet seat composed of foliar plates 4*a* and 4*b* connected to each other overlappingly vertically by means of a pin 24, in which cap-type supports 22 are fixed to C1 and C2 points of back surfaces of the foliar plates 4*a* and 4*b*, are inserted into cylindrical receiving supports 22 fixed to both ends of a fixed plate 25, and by pushing a knob 26 of a front portion side surface of the foliar plate 4*a*, the support 22 is operated by a a lever to vary the opening width of the toilet seat symmetrically with respect to the left and right.

5. Referring to the above item 4, as described in FIG. 5(*b*), a cylindrical hole in which the receiving support 22 is to be inserted is formed in the back surface of the portion C2 of the foliar plate 4*b* of the toilet seat.

The opening width of the toilet seat used by adults in the toilet stool capable of being seated for urination and defecation in accordance with the present invention can be easily varied by one touch manuallly or electrically.

For example, when a child sits on a toilet seat, the opening width of the toilet seat is too large, the opening width of the toilet seat can be varied to the opening width of the toilet seat for children by one touch manually or electrically. Hence, the above toilet stool is free from the complexity and the inconvenience of exchanging the child toilet seat, which are the conventional problems.

Heretofore, since an ordinary toilet stool has been provided with an adult toilet seat, when a child sits on a toilet seat, the opening width of the toilet seat is too large to use, and it is inconvenient.

Figure 6A:
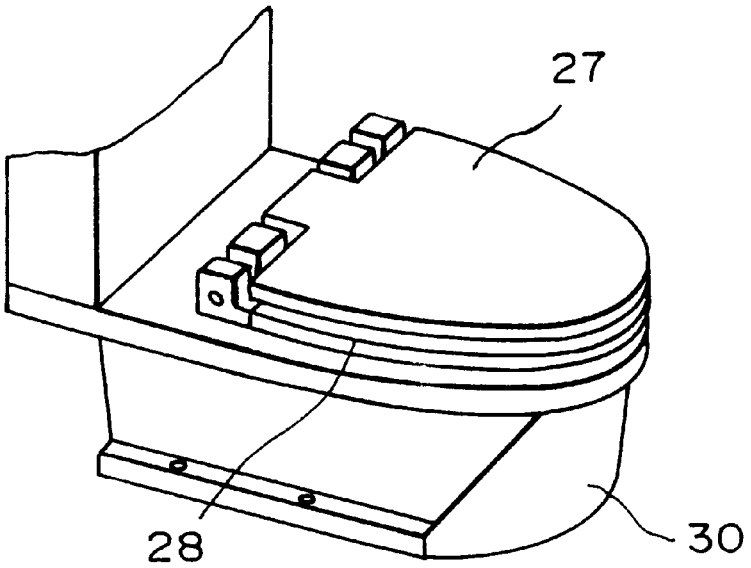
PRIOR ART FIG. 6a
FIGS. 6(*a* and *b*) are a perspective view of the toilet seat and the toilet stool described in Comparative Example 1.
Figure 6B:
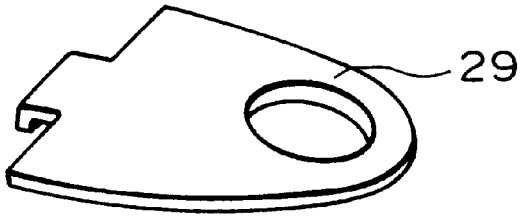

As a simple method, as shown in Comparative Example disclosed in FIG. 6 given below, the stool lid 27 is removed and in place of the removed lid 27, a child toilet seat 29 is secured on an adult toilet seat 28.

However, according to this proposal, when the child toilet seat is not used, it is stored in another place in the toilet, and as required, the child toilet seat when in use is put in place by man. This is troublesome, because it is difficult to find the place in the toilet where the child toilet seat is stored.

When an adult goes to stool, unless the child toilet seat is removed, the adult who is seated may contact the back surface portion of the child toilet seat which is pushed upwardly. The above anxiety, unpleasantness, or dirty feeling may be given to the adults.

As is clearly shown from the concept view of FIG. 1, the opening width portion of the toilet seat of the present invention may be varied by driving the two foliar plates 4, which are symmetrical to both left and right, in the front and rear directions [see FIG. 1(*b*)], and by driving the foliar plates 4 of the toilet seat to the left and right directions thereby [see FIG. 1(*c*)].

Accordingly, by mounting the toilet seats of the present invention on the seatable toilet stool capable of being seated, it is not necessary to exchange the toilet seat quite differently from the simple method described above, and by varying the opening width of one toilet seat to an opening width necessary for a child going to stool. This is a great characteristic of the present invention.

Figure 3A:
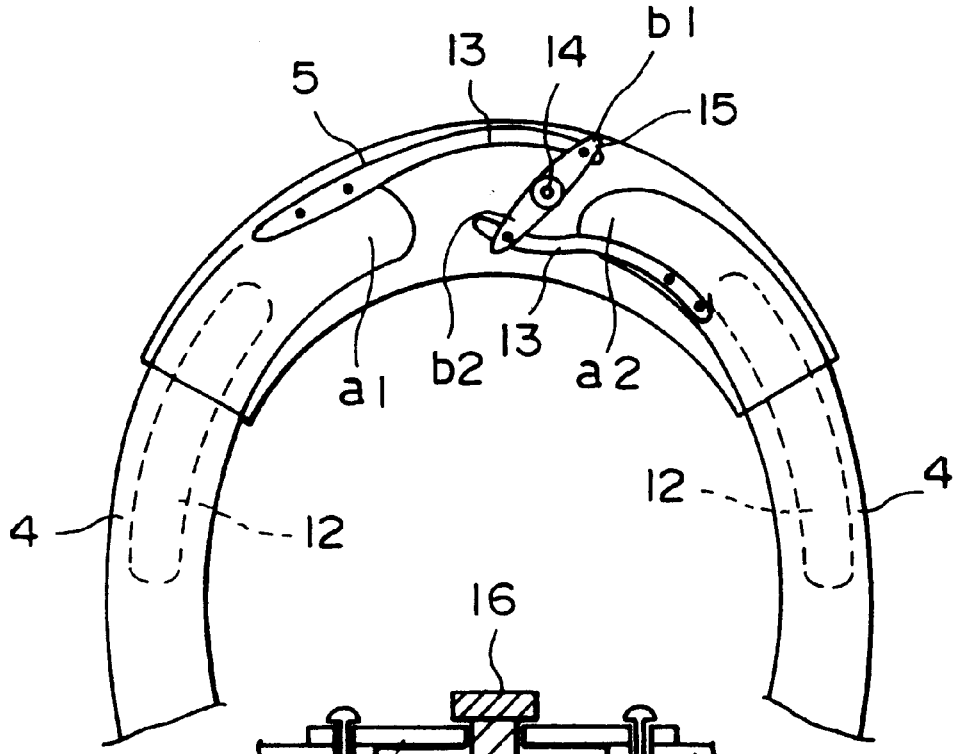
FIGS. 3(*a* and *b*) are a top view and a partially front sectional view of a driving portion and foliar plates of a toilet seat whose opening width of the toilet seat is varied by driving foliar plates described in Example 2 of the present invention to the front and rear directions.
Figure 3B:
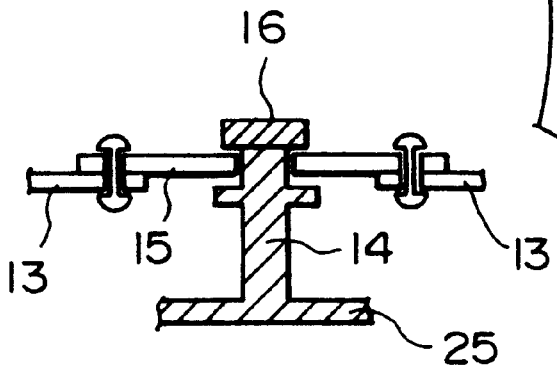
Figure 5A:
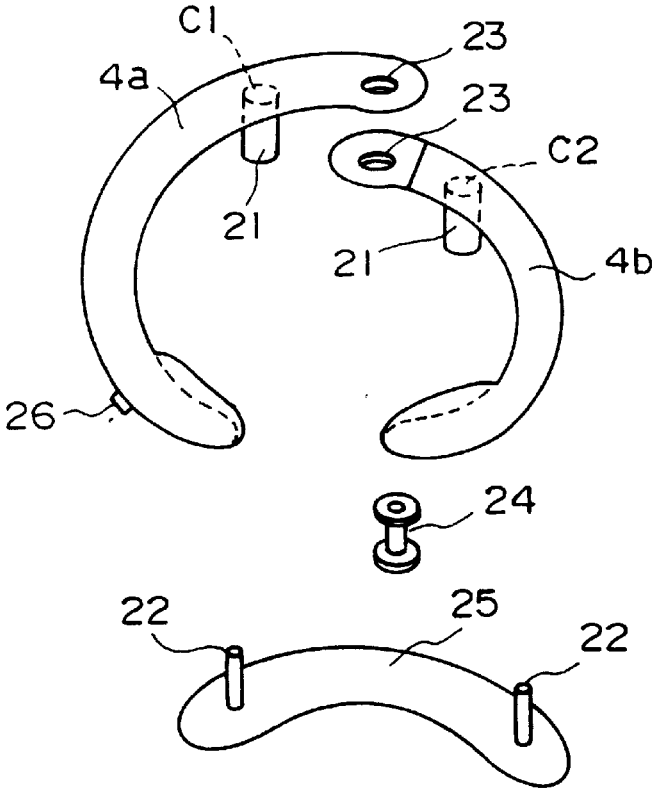
FIGS. 5(*a* and *b*) are a perspective view and a partially front sectional view of a driving portion and foliar plates of a toilet seat whose opening width of the toilet seat is varied by driving foliar plates described in Example 4 (FIG. 5*a*) and Example 5 (FIG. 5*b*) of the present invention in the left and right directions.
Figure 5B:
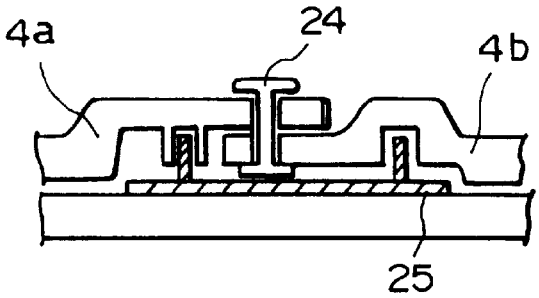

The former method by the present invention includes varying the opening width of a toilet seat by driving the foliar plates of the toilet seat to the front and rear directions by an electric operation in Example 1 (see FIG. 2), and varying the opening width of a toilet seat by pressing the knob (see FIG. 5(*a*) at a front portion side surface of the foliar plates of a toilet seat manually in Example 2 to drive the foliar plates of the toilet seat to the front and rear directions (see FIG. 3).

By taking up Example 1 as an example, the method of varying the opening width of the toilet seat by this method will be illustrated in details.

The foliar plates of the toilet seat which are mounted in the present invention can vary the opening width of ordinary-type usual foliar plates of the toilet seat by applying a slight driving force which can vary the opening width. Or in view of the stability at the time of sitting, it is not limited to the shape to be described below. It is more preferred to mount a foliar plate in which as compared with a conventional type, the front portion of the foliar plate is widely broadened inwardly of the toilet seat to about a length of 5 to 10 cm and a width of 2 to 4 cm (see FIG. 1).

Referring to Example 1 in FIG. 2, the gear 7 meshes with the arm-like one side gear 8 fixed to the rear portion of the left and right foliar plates of the toilet seat, and for example, when the gear motor rotates counterclockwise, both foliar plates of the toilet seat are simultaneously driven so that these foliar plates are drawn toward the rear portion of the toilet seat.

As a result, the opening width of a toilet seat usually for adults as shown in Example 1 is narrowed to a size on which a child can feel easy and sit on the toilet seat.

Furthermore, according to the present invention, in the method of driving foliar plates of a toilet seat in the front and rear directions as in the latter method, a driving guide is provided in order to drive foliar plates of a toilet seat smoothly in the front and rear directions as a further characteristic of the present invention.

In the back surface of the foliar plates 4 of the toilet seat in the present invention, grooves in which a top 10 rotating freely is accmmodated and is secured to a fixed plate 9 described in FIG. 2(*b*), are engraved. When the foliar plates of the toilet seat are actuated at the fulcrum, the top rotates collectively with this actuation so as to slide over the side wall surface within the groove, and both foliar plates of the toilet seat move smoothly by this rotating top along the engraved grooves (see Example 1).

In the former method, it is important that with respect to the arm-like joint described in FIG. 2(*a*), one end of the one side gear 8 as this joint is fixed to the inside of a forward end portion and the outside of a forward end portion toward the rear portion of the toilet seat of both foliar plates. This is because when the fixed portion is nearer to the central portion of the foliar plate of each toilet seat, the difference in the centrifugal force action affects the motor 7, and a stronger rotating load is exerted on the gear 8 (see Example 1). The manual method in Example 2 described in FIG. 3 may be the same.

According to the latter method of driving both foliar plates of the toilet seat in the left and right directions, the opening width of the toilet seat is varied by simultaneously narrowing or broadening the foliar plates of the toilet seat in the front and rear directions electrically (see FIG. 4), and the opening width of the toilet seat is varied by pressing the side surface knob 26 in the front portion of the foliar plates of the toilet seat as in Example 4 by manual operation whereby both foliar plates in the toilet seat are linked by a screw, in the cylindrical hole 23 and by driving the foliar plates of the toilet seat to in the left and right directions as in Example 3 (see FIGS. 5(*a*) and (*b*)).

Figure 4A:
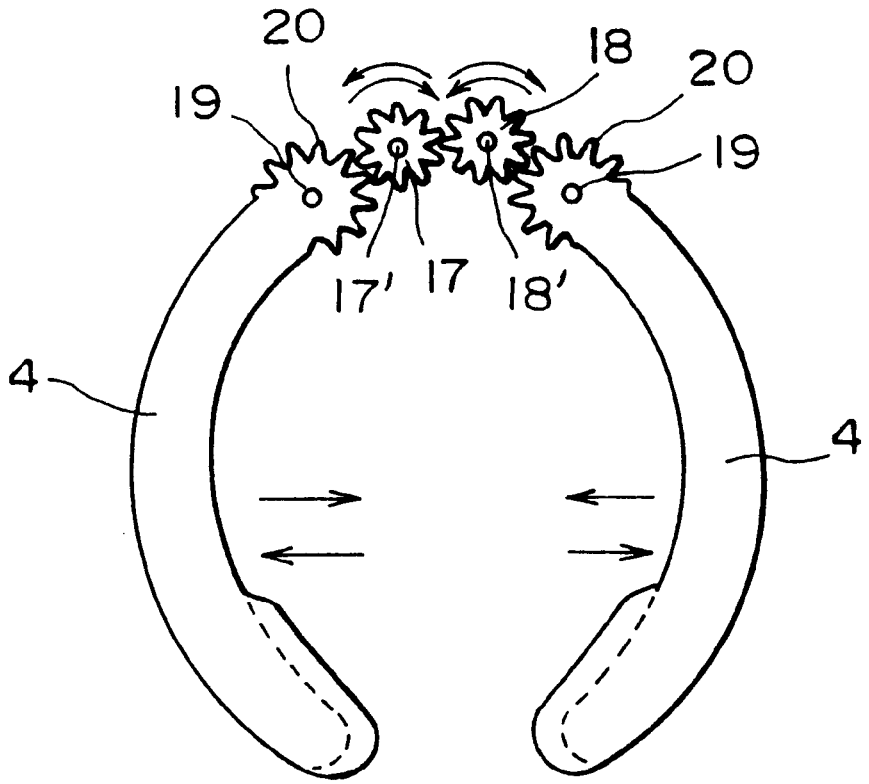
FIGS. 4(*a* and *b*) are a top view and a partially front sectional view of a driving portion and foliar plates of a toilet seat whose opening width of the toilet seat is varied by driving foliar plates described in Example 3 of the present invention to the left and right directions.
Figure 4B:
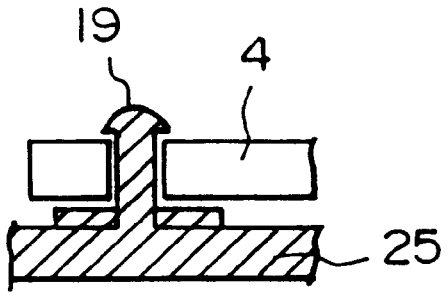

Referring to Example 3 in FIG. 4, the foliar plates of the toilet seat are driven to the left and right directions to vary the opening width of the toilet seat. In FIG. 4, when the gear motor 17 is rotated clockwise, the rotating gear 18 rotates counterclockwise.

As a result, the left of the meshing gear 20 at an end portion of the foliar plates of the toilet seat which are meshed with each other rotates counterclockwise, and the right of the meshing gear 20 rotates clockwise. Hence, both foliar plates of the toilet seat are driven inwardly of the opening width of the toilet seat, and therefore, the opening width of the toilet seat is narrowed.

The stool provided with a toilet seat whose opening width can be varied can solve the inconvenience at the time of going to stool. In addition, a usual opening width can be varied so that the foliar plates of the toilet seat can be broadened on the outside of the toilet seat. Thus, when an adult goes to stool, there is no need to elevate the toilet seat, but when the adult goes to stool by broadening the foliar plates of the toilet seat by one touch, the scattering of urine during urination against the upper surface of the toilet seat can be prevented. Accordingly, even when an adult woman sits on the seat, she can use the seat without having a feeling of discomfort nor a feeling of dirtiness.

(Fixed plate)

The U-shaped fixed plate 9 of the present invention is fixed in the lower portion of a cover 5 of the driving portion by a burying type method or a screwing method, and becomes integrated with the cover 5.

Accordingly, when the cover 5 in the driving portion is mounted on the main body of the stool fallably, a kind of case is formed from the cover in the driving portion and the fixed plate. In the case, the rear portions of both foliar plates of the toilet seat are accommodated in the driving portion in a linked state.

In the fixed plate described above, a constituting member which drives the variable type foliar plates of the toilet seat is provided. Accordingly, the fixed plate in the present invention is a very important member as a base of a driving portion for varying the opening width of the toilet seat.

In the present invention, the constituting members provided in this base are shown as follows.

1. In Example 1, the gear motor 7 and the top 10 assisting the driving of the foliar plates of the toilet seat.

2. In Example 2, a rotating shaft 14 for maintaining the rotation of the rotating joint fitting 15 and the top 10 assisting the driving of the foliar plates of the toilet seat.

3. In Example 3, the gear motor 17, the rotating gear 18, and the actuation shaft (rotating shaft) of the foliar plates 19 of the toilet seat.

4. In Example 4, a cylindrical support 22 in which a cap-type support on the back surface of the foliar plates of the toilet seat.

The qualities of the fixed plate include metal plates such as stainless steel, iron, and titanium. From the standpoint of anti-corrosive prevention, stainless steel and titanium are preferred. In addition to melt plates, various plastic materials may be preferably used as required.

EFFECT OF THE INVENTION

According to the present invention, there is provided a stool provided with a toilet seat whose opening width of a toilet seat can be varied properly at a driving portion of the rear portion of the toilet seat composed of foliar plates of the toilet seat, wherein the toilet seat is composed of two foliar plates of the toilet seat which are symmetrical with respect to left and right and are capable of freely falling.

The opening width of the toilet seat can be varied by driving foliar plates of the toilet seat manually or electrically by one touch simultaneously in the front and rear directions or in the left and right directions.

When a child goes to stool by using a stool on which a toilet seat for varying the opening width of the seat is mounted, the opening width of a toilet seat for adults is varied to that for chindren, and the child can safely vary the opening width of the toilet seat and goes to stool. Thus, the children can solve the inconvenience of exchaning the seat for adults to a seat for children.

EXAMPLES

Example 1

When the invention is described with reference to FIG. 2, the characteristic of this toilet seat whose opening width can be varied is that it is electrically operated, and by moving the foliar plates 4 of a toilet seat to the front and rear directions, the opening width of the toilet seat can be varied by narrowing or broadening.

The construction of the driving portion which can operate the foliar plates 4 of the toilet seat is as follows. When the gear motor 7 is rotated counterclockwise, since this gear is meshed with the arm-like one side gear 8, the foliar plates 4 of the toilet seat interlock and move toward the rear portion of the toilet seat. As a result, a usual opening width of a toilet seat for adults is varied.

On the other hand, when the motor 7 is moved inversely, foliar plates 4 of the toilet seat move toward the front portion of the toilet seat. Thus, the opening width of the toilet seat is varied to broaden the opening width.

As is clear from FIG. 2(*a*), in comparison with the case where the one side gear 8 in this Example is fixed to the inside of the forward end portion and the outside of the forward end portion toward the rear portion of the toilet seat of foliar plates, when the fixing portion is near the central portion of the foliar plates of the toilet seat, a larger rotating load is exerted on the gear motor 7, and the movement of the foliar plates of the toilet seat becomes difficult.

Furthermore, the guiding effects of the grooves 12 of the foliar plates of the toilet seat described in FIG. 2(*d*) and of the rotating top 10 supported by the fixed plate 9 described in FIG. 2(*b*) give a large difference when they are present or not in the point of smoothly enabling both foliar plates of the toilet seat to move.

From the above results, by mounting this toilet seat on the stool, when a child goes to stool, the opening width of an ordinary toilet seat for adults will be easily varied electrically to an opening width of a toilet seat for children.

In addition, since by using one toilet seat, a child can safely sit on the toilet seat and go to stool, it is possible to provide a toilet seat free from complexity as in a comparative example (conventional type).

When a man urinates before a woman, the toilet seat is manually drawn upwardly and the gear motor 7 is reversed so as to broaden the foliar plate outwardly. Scattering and contamination of urine against the upper surface of the foliar plates of the toilet seat can be prevented. When an adult woman sits on the seat, no discomfortable feeling is given to her.

Example 2

With reference to FIG. 3, the characteristic of the variable-opening toilet seat is that it is manually operable, and instead of the gear motor 7 constituting a driving portion for moving the foliar plates in Example 1, there is used a rotation joint 15 which rotates on a rotation shaft 14 as a fulcrum in an interlocking relation with the arm fitting 13 and in which the foliar plate is actuated by leverage by pressing a knob (as shown in FIG. 5a) on the side surface of a forward portion of foliar plates of the toilet seat. The mechanism and action of varying the foliar plates of the toilet seat are the same as in Example 1.

Example 3

With reference to FIG. 4, the characteristic of this variable type toilet seat is electrically operable. This toilet seat is that the moving direction of the foliar plates 4 of the toilet seat is different from the front and rear directions in Examples 1 and 2, but an opening width of the toilet seat is varied by actuating the foliar plates 4 to the left and right.

As is clear from FIG. 4(*a*), the construction of the driving portion of moving the foliar plates 4 of the toilet seat is that the gear motor 17 is a rotating shaft (fulcrum), and when it is rotated and actuated clockwise, the rotation gear 18 meshing with it rotates counterclockwise. As a result, since the gear 19 meshing with the left of terminal plate portion of foliar plates rotates counterclockwise, and the gear 19 meshing with the right rotates clockwise, both foliar plates are moved inwardly of the opening portion to narrow the opening width of the toilet seat.

When the gear motor 17 is rotated and started counterclockwise, the gear motor 17 is reversed, and the opening width of the toilet seat is easily broadened so that the opening width of the toilet seat can be returned to a usual opening width.

Example 4

With reference to FIG. 5(*a*), the characteristic of this variable type toilet seat is that it is manually operable, and the moving directions of the foliar plates 4 of the toilet seat are the left and right directions in Example 3 to vary the opening width of the toilet seat.

The construction of the driving portion of moving the foliar plates of the toilet seat is that by pressing the knob 26 of the side surface of the front portion in the left foliar plate of the toilet seat, the left foliar plate 4*a* of the toilet seat rotates and starts on the support 22 as a fulcrum. At the same time, both foliar plates of the toilet seat are linked by passing a pin 24 through an elliptical hole 23 provided at the end portion of the rear portion of the left foliar plate and the same hole 23 provided at the right foliar plate 4*b* of the toilet seat. In addition, since the hole 23 is opened in a larger diameter than the diameter of the pin 24, due to the reaction occurring when the pin 24 contacts the inside surface of the hole 23, one foliar plate 4*b* of the toilet seat interlocks at the support 22 and is actuated and the foliar plate 4*b* of the toilet seat rotates toward the inside of the toilet seat to narrow the opening width of the toilet seat. Furthermore, when the above knob is pulled to the outside, the opening width of the toilet seat becomes broad.

Example 5

With reference to FIG. 5(*b*), there is an improved-type of foliar plates of a toilet seat in Example 4. The characteristic of this improved type is that since both foliar plates are linked by vertically overlapping at the driving portion, the surface of a toilet seat formed with left and right two foliar plates is liable to develop a difference in level between the left and right. One proposal of removing the difference in level is given herein.

Since the left foliar plate 4*a* is mounted on the driving portion in the same way as in Example 4, the surface of the right end portion is overlapped downwardly in the linking portion by a pin 23. Hence, no difference in level is developed. Thus, this toilet seat is produced by using a cylindrical hole in which a support 22 of the right foliar plate is inserted in the back side of the foliar plate 4*b* of the toilet seat.

COMPARATIVE EXAMPLE

Figure 7A:
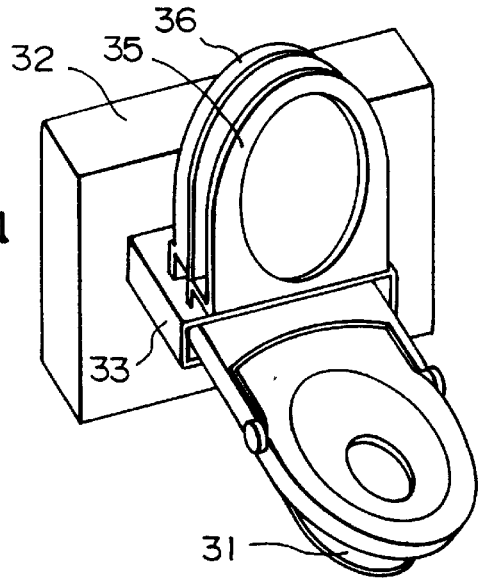
PRIOR ART FIG. 7a
FIGS. 7(*a* and *b*) are a perspective view of a multi-functional toilet stool apparatus provided with a child toilet seat described in Comparative Example 2 and other functions.
Figure 7B:
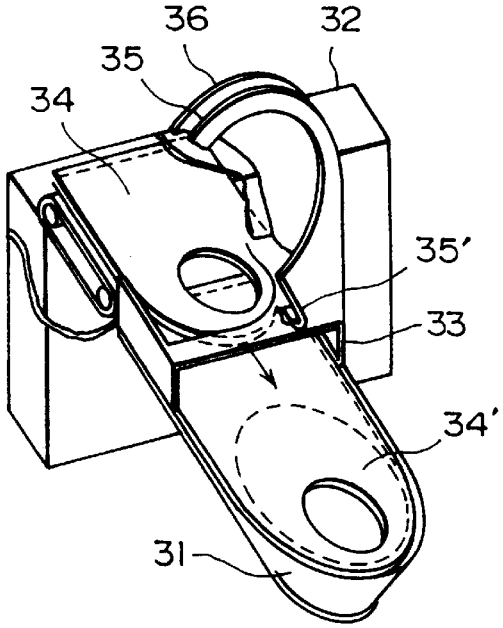

The stools described in FIGS. 6 and 7 are comparative examples of the present invention. In FIG. 6, when, for example, a toilet seat 29 for children is used, the stool lid 27 is removed from the main body of the stool and the toilet seat 29 for children is placed on the mounted toilet seat for adults and used in this state. As compared with the opening width-variable type toilet seat of the present invention, the complexity of using the above toilet seat is clearly seen.

In FIG. 7, the toilet seat 35 for adults is pulled up and erected, and the toilet seat 35 for children housed in the cabinet 32 is operated electrically, and placed into and out of the toilet through the case 33. In comparison with the comparative example of FIG. 6, various problems are solved, but when compared with the present invention, the devices in the comparative example are still complex. The stool becomes larger and the toilet still requires larger spaces.

What is claimed is:

1. A toilet seat in which the width of the toilet opening is variable and capable of falling onto the upper surface of a peripheral edge portion of a toilet stool as a pedestal, which comprises:

two foliar plates, which are symmetrical to the left and right and are curved, and which form the toilet opening on the upper surface of the peripheral edge portion of the toilet stool, and a driving portion in the rear portion of the toilet seat, which is united with the foliar plates, so that the width of the toilet opening may be varied, wherein, an actuation shaft is provided in the driving portion in the vertical direction, the actuation shaft is capable of rotating manually or electrically, and the foliar plates are driven simultaneously on the upper surface of the peripheral edge portion of the toilet stool, by the rotation of the actuation shaft as a fulcrum, so that the width of the toilet opening is varied.

2. A toilet seat of claim 1, wherein the driving portion comprises a member fitting having two ends and rotatable on a fulcrum, the seat further comprises two arm joints each rotatably attached to a respective end of the member fitting, and wherein an end of each arm joint is fixed to a respective end of each foliar plate, whereby rotating the member fitting on the fulcrum varies the opening width of the toilet seat.

3. A toilet seat of claim 1 wherein the driving portion comprises a motor equipped gear rotating about a first fulcrum and a second gear rotating about a second fulcrum and wherein the motor equipped gear and the second gear mesh with each other, wherein the two foliar plates are each formed with an integral gear at one end, and wherein the motor equipped gear and the second gear each mesh with a respective integral gear, whereby by rotating the motor equipped gear about the first fulcrum the second gear is rotated about the second fulcrum and the foliar plates are driven inward and outward to vary the opening width of the toilet seat.

4. A toilet seat of claim 1 wherein the two foliar plates are each formed with a pin insertion hole at one end, the seat further comprises a pin loosely engaging the two pin insertion holes whereby respective ends of the two foliar plates vertically overlap, two cap-type supports each fixed to a respective foliar plate at a respective back end of the plate, and a fixed plate with two cylindrical supports attached thereto wherein each cylindrical support defines a fulcrum and is inserted into a respective cap-type support, whereby pushing and pulling a knob on a front side surface of one foliar plate drives the foliar plates inward and outward, respectively.

5. A toilet seat of claim 4 wherein a receiving support of a portion of the foliar plate of the toilet seat is engraved in a cylindrical shape on the back surface of the foliar plate of the toilet seat.

6. A toilet seat in which the width of the toilet opening is variable and capable of falling onto the upper surface of a peripheral edge portion of a toilet stool as a pedestal, which comprises:

two foliar plates, which are symmetrical to the left and right and are curved, and which form the toilet opening on the upper surface of the peripheral edge portion of the toilet stool, and a driving portion in the rear portion of the toilet seat, which is united with the foliar plates, so that the width of the toilet opening may be varied, wherein, an actuation shaft is provided in the driving portion in the vertical direction, the actuation shaft is capable of rotating manually or electrically, and the foliar plates are driven simultaneously on the upper surface of the peripheral edge portion of the toilet stool, by the rotation of the actuation shaft as a fulcrum, so that the width of the toilet opening is varied, and wherein, a driving rotating gear is provided as the actuation shaft in the driving portion, two arm-like one side gears are provided in the rear ends of the foliar plates, respectively, the arm-like one side gears bite with the driving rotating gear so that the lines of the teeth of the arm-like one side gears face each other with the driving rotating gear between, thereby the driving portion is united with the foliar plates, and the foliar plates are driven simultaneously on the upper surface of the peripheral edge portion of the toilet stool, by the rotation of the driving rotating gear, so that the width of the toilet opening is varied.

* * * * *